US008317268B2

(12) United States Patent
Alkhattaf

(10) Patent No.: US 8,317,268 B2
(45) Date of Patent: Nov. 27, 2012

(54) PORTABLE FOOTREST FOR USE WHEN SITTING ON A TOILET

(76) Inventor: Solaiman B. S. A. Alkhattaf, Alqadsia (KW)

( * ) Notice: Subject to any disclaimer, the term of this patent is extended or adjusted under 35 U.S.C. 154(b) by 144 days.

(21) Appl. No.: 12/983,966

(22) Filed: Jan. 4, 2011

(65) Prior Publication Data

US 2012/0169106 A1 Jul. 5, 2012

(51) Int. Cl.
*A47C 16/02* (2006.01)
*E03D 11/00* (2006.01)

(52) U.S. Cl. ..... 297/423.39; 297/423.41; 297/423.44; 4/254

(58) Field of Classification Search ..... 297/423.39, 297/423.41, 423.44; 4/254
See application file for complete search history.

(56) References Cited

U.S. PATENT DOCUMENTS 933,148 A * 9/1909 Wilson ..... 4/254
1,067,767 A * 7/1913 Simonson ..... 4/254
1,798,632 A * 3/1931 Romer ..... 4/254
2,023,901 A 12/1935 Rhodes
2,243,264 A * 5/1941 Stromblad ..... 4/254
2,250,060 A 7/1941 Finlay
2,834,028 A * 5/1958 Stanley ..... 4/254
3,005,662 A * 10/1961 Emery ..... 297/423.39
4,244,064 A * 1/1981 Parr ..... 4/254
4,254,514 A 3/1981 Sakamoto
4,713,846 A 12/1987 Hodroski, Jr.
4,979,240 A 12/1990 Welles
5,028,024 A 7/1991 Welles
5,282,279 A * 2/1994 Hinton et al. ..... 4/254
5,553,334 A * 9/1996 Hillman ..... 4/420
5,809,583 A * 9/1998 Pucciani ..... 4/254
6,148,448 A * 11/2000 Urso ..... 4/254
6,174,026 B1 * 1/2001 Wise ..... 297/423.41 X
6,256,800 B1 * 7/2001 Isbit ..... 4/254
6,631,524 B1 10/2003 Dixon
6,681,410 B1 * 1/2004 Husain ..... 4/254
6,715,161 B1 * 4/2004 Depoe, Jr. ..... 4/254
7,669,934 B1 * 3/2010 Cline ..... 297/423.45
D625,116 S * 10/2010 Willner ..... D6/349
7,814,581 B1 * 10/2010 Willner ..... 4/254
7,987,529 B1 * 8/2011 Wise ..... 4/254
2009/0145340 A1 * 6/2009 Parvizian ..... 4/254 X

* cited by examiner

*Primary Examiner* — Rodney B White
(74) *Attorney, Agent, or Firm* — Lowe Hauptman Ham & Berner, LLP

(57) ABSTRACT

A portable footrest for elevating the feet of an individual when seated on a toilet includes an elongated carrying case and two collapsible rectangular box like support members. The footrest also includes a cross member for positioning the support members in a temporarily fixed spaced relationship. Each of the support members includes four rectangular or square shaped elements pivotally connected to one another and wherein one of the side of one of the elements is releaseably connected to an opposite side of another of the elements and each of the support members is positionable in a flat linear end-to-end relationship with two interior elements and two end elements for storage in the carry case. A block on three of the elements prevent the elements from rotating more than about 90° when forming a rectangular box like support. Further, a releaseable latch fastens the outer edges of the elements to form a box like structure.

9 Claims, 4 Drawing Sheets

PORTABLE FOOTREST FOR USE WHEN SITTING ON A TOILET

FIELD OF THE INVENTION

This invention relates to a portable footrest for use when sitting on a toilet and more particularly to a portable footrest for elevating the feet of an individual to thereby provide a more natural position for eliminating waste from the human body.

BACKGROUND FOR THE INVENTION

The user of a Western style toilet is generally in a seated position with the femur portion of each leg extending approximately horizontal and the lower portion of the legs extending downwardly therefrom. By comparison Eastern or Arabic style toilets are used in a squatting position wherein an individual's thighs are extended or canted upwardly. Some believe that the squatting position is more natural and properly aligns the intestines, allows the use of gravity and abdominal tension while relieving strain on sphincter muscles to facilitate bowel movement and in passing urine. It is also alleged that problems of the urinary and lower digestive track may be attributed to the unnatural position during waste elimination by the use of conventional Western style toilets.

There have been many attempts to combine the advantages of Eastern and Western style toilets by the use of footstools for elevating a user's feet when using a Western style toilet. For example, a Finlay U.S. Pat. No. 2,250,060 discloses a footstool adapted for use with sanitary closets. As disclosed, a footstool or platform is provided for the purpose of obtaining with a toilet of ordinary height the physiological advantages of a "squatting position."

A further apparatus for assisting a person using a toilet in completing a successful bowel movement is disclosed in a Sakamoto U.S. Pat. No. 4,254,514. As disclosed, a horizontal seat member defining a central vertical opening therethrough is provided for stationary support from the open upper end of a toilet bowl. The seat member includes front, rear and opposite side portions and defines an upper seat surface which is upwardly concave in a front-to-rear extending direction for more readily conforming to the lower torso configuration of a person having his or her legs bent sharply in positions similar to those assumed when the person is in a squatting position. The forward extremity of the seat member includes a depending portion terminating downwardly in a forwardly and horizontally directed footrest portion for support of the user's feet and the seat member has a hinged cover operatively associated therewith, the cover including first and second sections thereof pivotally joined together along adjacent marginal portions and being swingable between a raised upstanding open position with the cover sections substantially coplanar and a lowered horizontal position with the cover sections relatively oppositely inclined downwardly toward the adjacent marginal edges thereof. This way the cover conforms to the concave seat member. The cover includes structure thereon for releasably retaining the cover sections in the coplanar position.

In addition, a footrest for a conventional toilet is described in a Welles U.S. Pat. No. 5,028,024. The Welles patent discloses a footrest for a conventional toilet that may be conveniently stored in a nested position under the toilet bowl. The footrest has a left side frame and a right side frame that are connected at their forward ends by a telescoping connecting member. The side frame members each include a vertically oriented U-shaped portion that is connected to a cantilever portion having foot platforms mounted thereon. The footrest is used to facilitate a toilet user assuming a semi-squatting position during use. The footrest may also be used by children or other person's whose legs do not reach the floor when on the toilet.

Finally, a height adjustable footrest for toilets is described in a Dixon U.S. Pat. No. 6,631,524. As disclosed therein a height-adjustable footrest for toilets for preferably using while a user is seated upon a toilet stool includes a base adapted to rest upon a floor and an upright adjustable support assembly mounted upon the base and including tubular base members each having an open top end and a bore extending therein. It also includes shaft members being moveably disposed inwardly and outwardly of the tubular base members and further includes elongate cross members being mounted upon a shaft members with each of the cross members interconnecting a pair of the shaft members. In addition, the footrest includes an elongate footrest support member pivotally disposed between and interconnecting the elongate cross members and further includes footrest members being mounted to the elongate footrest support member and an assembly for raising and lowering the footrest members.

Notwithstanding the above, it is presently believed that there is a need and a potential commercial market for an improved footrest for a toilet in accordance with the present invention. There should be a need and a potential commercial market for such footrest because they are portable, of relatively simple design and can be manufactured and sold at a reasonable cost. Further, such footrest are of light weight construction, durable, and storeable in a carry case for ease in moving from one facility to another.

BRIEF SUMMARY OF THE INVENTION

In essence the present invention contemplates a portable footrest for elevating the feet of an individual when sitting on a Western style toilet. The footrest includes an elongated carrying case and two collapsible rectangular box like support members together with a removeable cross member for positioning and temporarily fixing the support members in a side-by-side spaced relationship. Further, each of the rectangular shaped support members include four rectangular shaped elements pivotally connected to one another and wherein one of the sides of each of the elements connected to an opposite side of another of the elements. Further, each of the support members is positionable in a flat linear end-to-end relationship with two interior elements and two end elements for storing in the carry case. In addition, the two end elements have an outer edge. Means for preventing the elements from rotating beyond about 90° when forming a rectangular box like support are provided together with means for releaseably fastening said outer edges together to form box like supports.

The invention will now be described in connection with the accompanying drawing wherein like reference numerals have been used to indicate like parts.

DESCRIPTION OF THE PREFERRED EMBODIMENTS OF THE INVENTION

Figure 1:
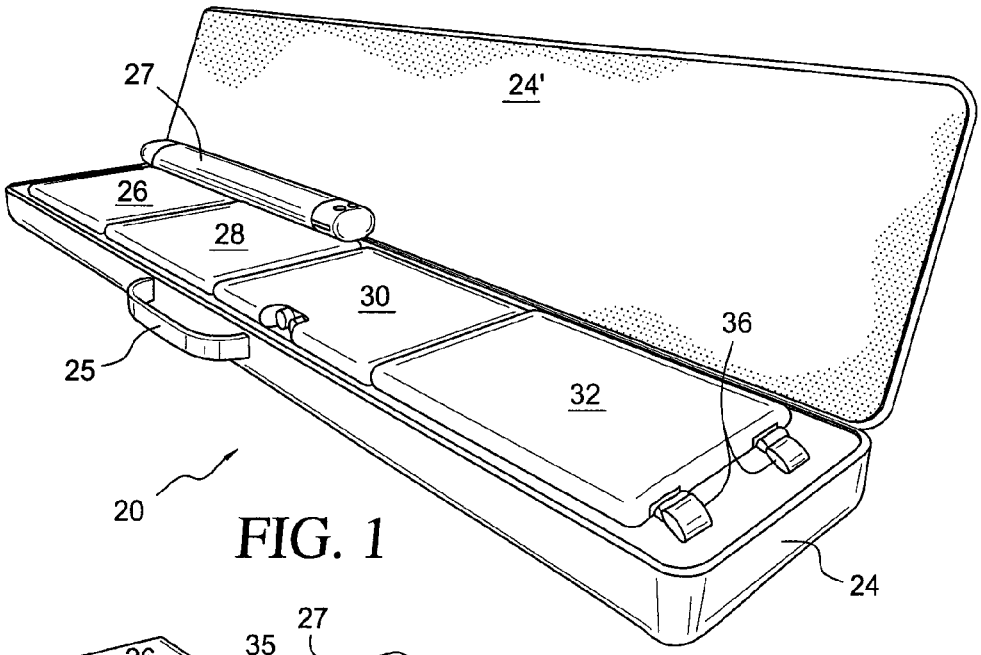
FIG. 1 is a perspective view of a carry case and portable footrest for use when seated on a toilet in accordance with a first embodiment of the invention.
Figure 2:
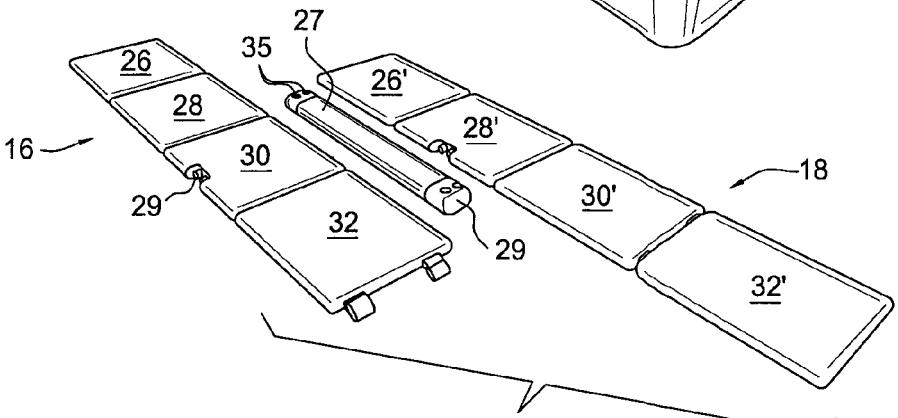
FIG. 2 is a perspective view of two foot supports including a plurality of rectangular elements for forming a generally box like structure for placing in the carry case on top of one another as illustrated in FIG. 1.

Throughout the world there are two basic types of toilets, the Arabic or Eastern style which is a flat shaped toilet at floor level that is normally found in Arabic and Asian countries and Western style toilets of the type commonly provided in America and Europe that have a chair like shape that supports an individual at a reasonable height above the floor.

The Eastern or Arabic toilet strains the joints and the knees which make it much harder to sit down and stand up before and after getting rid of human waste. This type of toilet has negative effects on the elderly. Nevertheless the Eastern or Arabic style toilet allegedly has an advantage in the easiness with which human waste is eliminated due to pressure on the colon.

Therefore, it is believed that the present invention will provide the advantages of both styles of toilets while avoiding their disadvantages. However, this is accomplished by providing a healthier way to rid ones self of human waste while providing a more comfortable position of the joints and knees as well as ease in sitting and getting up after elimination of human waste. Further, the footrest in accordance with the present invention is available in two embodiments. The first embodiment is a portable footrest as shown in FIGS. 1-11 while the second embodiment is a fixed or more permanent footrest as illustrated in FIGS. 12-15.

As illustrated in FIGS. 1-11, a portable footrest 20 for use with a conventional Western style toilet 22 (see FIGS. 8-11). The portable footrest 20 includes two separate foot supports 16 and 18 (see FIGS. 2-5). Each of the footrest 16 and 18 is placed in a carry case with one footrest on top of the other in an unassembled condition as shown in an elongated carry case 24 in FIG. 1. The elongated carry case includes a closeable cover 24' and a handle 25. A latch (not shown) may also be included. The portable footrest 20 includes four relatively flat rectangular elements 26, 28, 30 and 32 that may be square and that are hingedly connected together in a flat end-to-end relationship with two inner elements 28 and 30 and two outer elements 26 and 32. A second footrest includes four rectangular elements 26', 28', 30' and 32'. A cross member or cross bar 27 is constructed and dimensioned so that a first end 29 fits snuggly into a recessed area 29 and element 30 and has a second end 31 that fits snuggly into a second recessed area 31' and element 28'. As shown more clearly in FIGS. 4 and 7, each of the recessed areas 29 and 31 include a pair of projecting studs 33 in the form of right circular cylinders that fit snuggly into right circular cylindrical cavities 35 (see FIGS. 3 and 6) in the cross bar 27.

Figure 3:
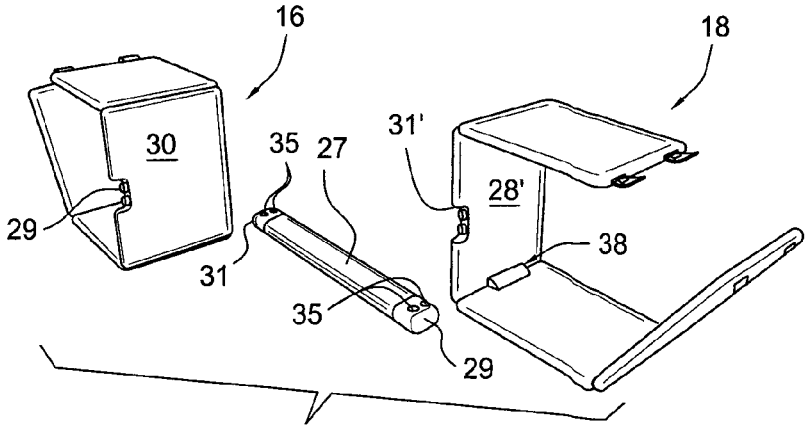
FIG. 3 is a perspective view of the partially assembled foot supports.
Figure 4:
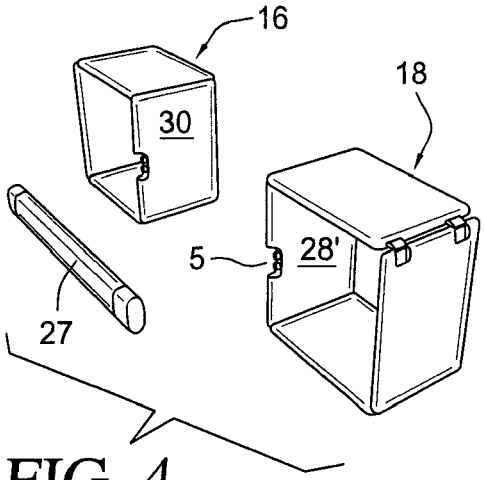
FIG. 4 is a perspective view of the two foot supports fully assembled and a cross member removed therefrom.
Figure 5:
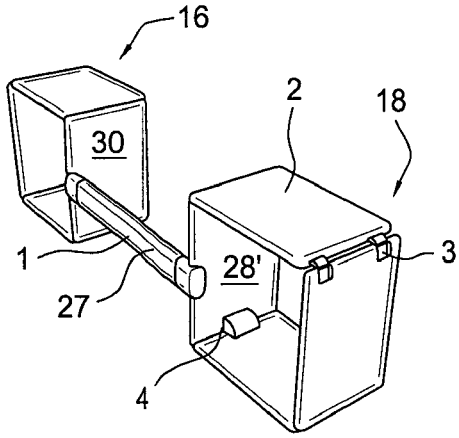
FIG. 5 is a fully assembled footrest in accordance with the present invention.
Figure 6:
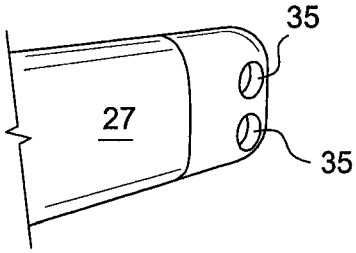
FIG. 6 is a perspective view of an end portion of the cross member shown in FIGS. 4 and 5.
Figure 7:
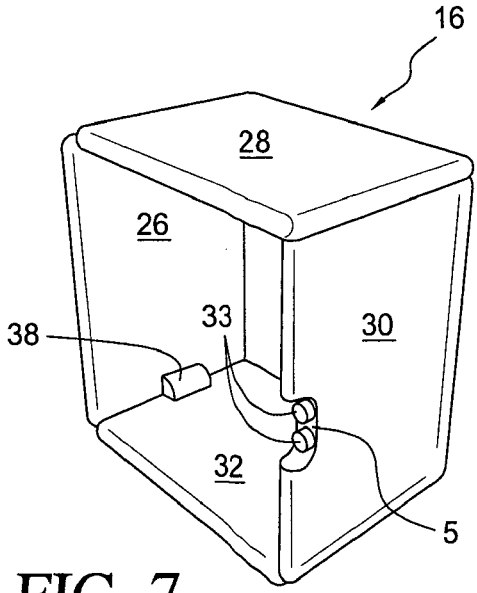
FIG. 7 is a perspective view of a foot support including a recessed area and outwardly extending projections for fastening a cross member (not shown) to the footrest.
Figure 8:
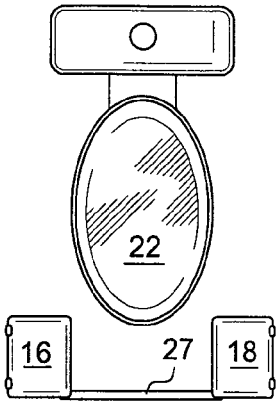
FIG. 8 is a top or plan view of a toilet and footrest in accordance with the present invention.
Figure 10:
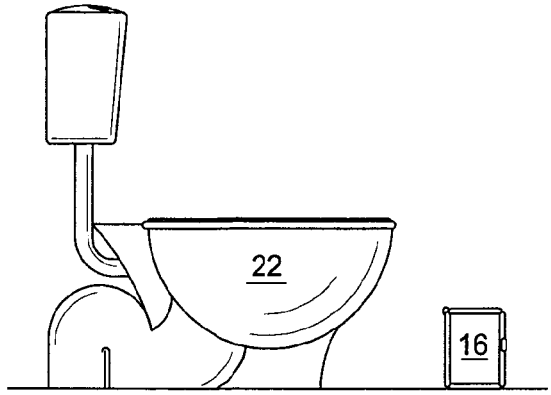
FIG. 10 is a side elevational view of a toilet and footrest in accordance with the present invention.
Figure 9:
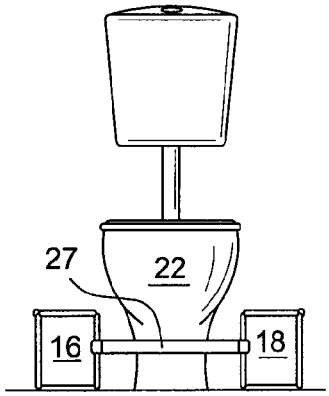
FIG. 9 is a front elevational view of a toilet and footrest in accordance with the present invention.
Figure 11:
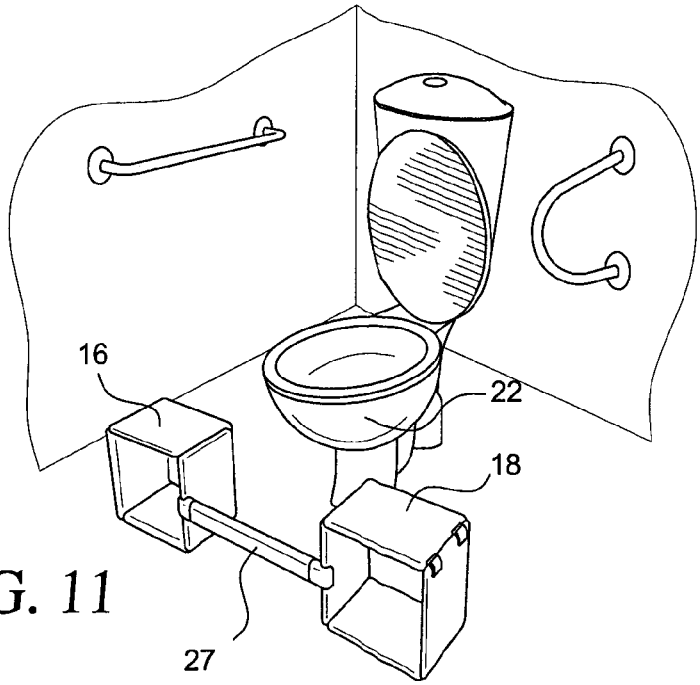
FIG. 11 is a perspective view of a footrest and toilet in accordance with the present invention.
Figure 12:
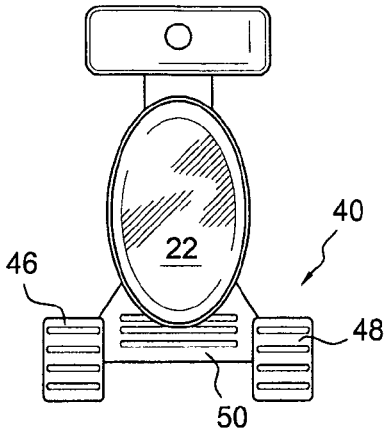
FIG. 12 is a top or plan view of a toilet and footrest in accordance with a second embodiment of the invention.
Figure 14:
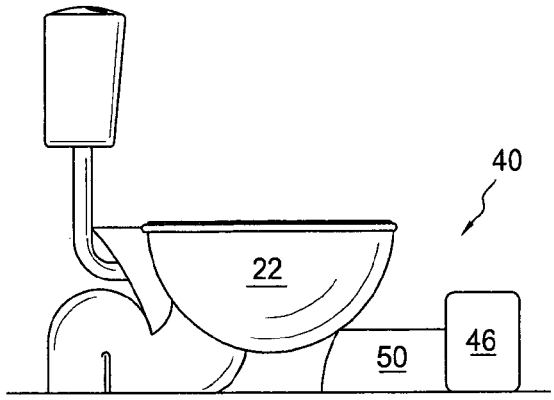
FIG. 14 is a side elevational view of the footrest and toilet shown in FIGS. 12 and 13.
Figure 13:
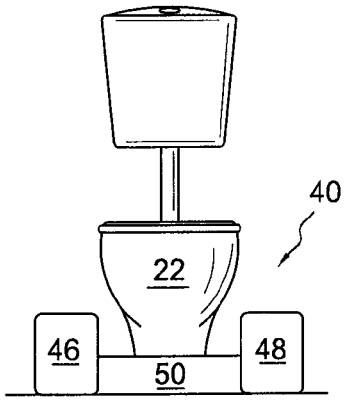
FIG. 13 is a front elevational view of a footrest and toilet in accordance with the second embodiment of the invention.
Figure 15:
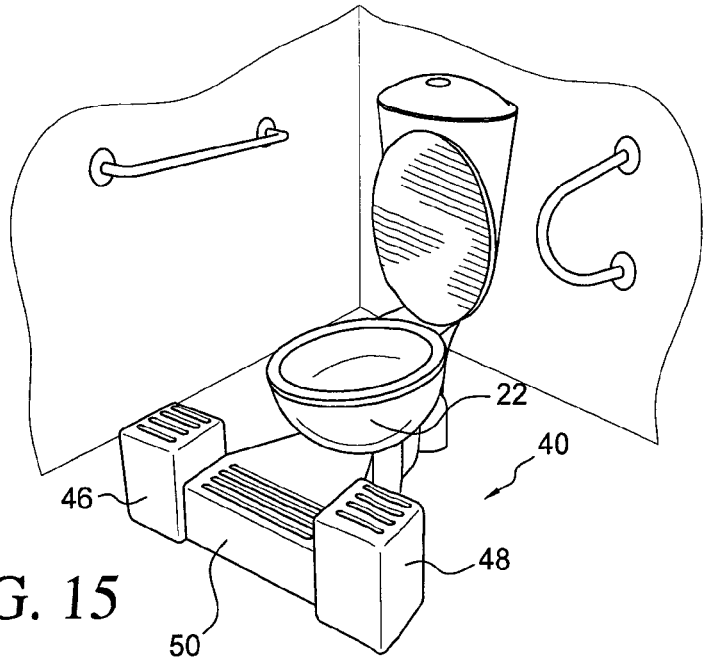
FIG. 15 is a perspective view of a toilet and footrest in accordance with a second embodiment of the invention.

Referring now to FIGS. 1, 3 and 4 each of the two foot supports 16 and 18 include means for fastening the outer edges of the outer elements together when the foot supports are assembled into a box like structure open in the front and rear thereof. In each support, the fastening means includes a pair of clamp like latching elements 36. Each latching element 36 includes a lever portion or clamping member for engaging a cross rod or wire 36' to pull the two sides tightly together. As shown in FIG. 3 at least two or three of the rectangular elements in each foot support includes a small blocking member 38 (only one shown) that prevent adjacent elements from rotating more than about 90° with respect to an adjacent rectangular element to thereby prevent the box like structure from collapsing.

A second embodiment of the invention will now be described with reference to FIGS. 12-15. As shown, a relatively permanent or fixed footrest 40 includes a pair of foot supports 46 and 48 and a cross member 50 that positions the foot support in a spaced relationship in front of the toilet 22. In the second embodiment of the invention the foot supports 36 and 38 each have a height of about 24 cm and width of about 16 cm while the cross member has a height of about 12 cms and a width of about 28 cm. The footrest and cross member each include a plurality of rubber strips on the upper surface thereof to prevent slippage and can be readily used by a small child in stepping up onto the footrest and sitting on the toilet. The length of the cross member 50 is about 20 cm or can be custom fit for various types of toilets.

While the invention has been described in connection with its preferred embodiment it should be recognized that changes and modifications may be made therein without departing from the scope of the appended claims.

What is claimed is:

1. A portable footrest for elevating the feet of an individual when sitting on a toilet, said footrest comprising:

an elongated carry case;

two collapsible rectangular box-shaped support members and a removeable cross member for positioning and temporarily fixing said support member in a side-by-side spaced relationship;

each of said rectangular shaped support members including four rectangular shaped elements pivotally connected to one another and wherein one of said sides of one of said elements releaseably connected to an opposite side of another of said elements and each of said support members positionable in a flat linear end-to-end relationship with two interior elements and two end elements for storing in said carry case and wherein each of said end elements have an outer edge;

means for preventing said elements from rotating beyond about 90° when forming a rectangular box-shaped support; and means for releaseably fastening said outer edges of said end elements to form said box-shaped support.

2. A portable footrest for elevating the feet of an individual when sitting on a toilet according to claim 1 in which said inner two elements are connected to one another and said two outer or end elements on opposite sides thereof.

3. A portable footrest for elevating the feet of an individual when sitting on a toilet according to claim 2 in which each of said supports includes a recessed portion along one side that is adjacent to the recessed portion in one side of the other support.

4. A portable footrest for elevating the feet of an individual when sitting on a toilet according to claim 3 in which said cross member is a cross bar.

5. A portable footrest for elevating the feet of an individual when sitting on a toilet according to claim 4 in which said recessed portion includes an outwardly extending short projection in the form of a right circular cylinder and said cross bar includes a corresponding cavity for tightly receiving said short projection therein.

6. A portable footrest for elevating the feet of an individual when sitting on a toilet according to claim 5 in which said means for releaseably fastening said outer edges of said outer sides of said outer elements are a pair of clamp members fixed to an outer portion thereof.

7. A portable footrest for elevating the feet of an individual when sitting on a toilet according to claim 6 in which each of said clamp members include a cross rod or wire and a lever engages said cross rod or wore and said lever being rotatable to pull said lever and said cross rod or wire tightly together.

8. A portable footrest for elevating the feet of an individual when sitting on a toilet, said footrest consisting of:

a relatively flat elongated carry case;

two collapsible rectangular box-shaped support members and a removeable cross bar for positioning and temporarily fixing said support member in a side-by-side spaced relationship;

each of said rectangular shaped support members including four rectangular shaped flat elements pivotally connected to one another in an end-to-end relationship with two inner elements and two outer elements with said inner elements connected to one another and to said outer element on opposite sides thereof and each of said outer elements having an outer edge with a recessed portion therein;

each of said recessed portions including two relatively short right circular cylindrical shaped projections and each end of said cross bar including two corresponding right cylindrical shaped cavities for receiving said two right circular shaped projections tightly fitted therein;

means for preventing said elements from rotating beyond about 90° when forming a rectangular box-shaped support member;

means for releaseably fastening said outer edges of said outer elements together;

wherein said means for releaseably fastening said outer edges of said outer elements together include a pair of clamp members with one of said clamp members at each outer position thereof and in which each clamp member consists of a cross rod or wire and a rotatable lever to pull said lever and said cross wire together; and wherein each of said foot supports has a height of about 24 cm and a width of about 16 cm and wherein said cross member has a width of about 28 cm and a height of about 12 cm.

9. A portable footrest for elevating the feet of an individual when sitting on a toilet according to claim 3 in which said cross member extends rearwardly and includes a fitted surface for engaging a portion of the toilet to thereby position said support members in a spaced relationship in front of the toilet and wherein said foot supports have a height of about 24 cm, a width of about 16 cm and a cross member having a width of about 28 cm and a height of about 12 cm.

* * * * *